US012030100B1

(12) United States Patent
Nakamoto

(10) Patent No.: US 12,030,100 B1
(45) Date of Patent: Jul. 9, 2024

(54) PRESS FORMING METHOD

(71) Applicant: JFE STEEL CORPORATION, Tokyo (JP)

(72) Inventor: Taira Nakamoto, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 18/287,714

(22) PCT Filed: Feb. 14, 2022

(86) PCT No.: PCT/JP2022/005594

§ 371 (c)(1),
(2) Date: Oct. 20, 2023

(87) PCT Pub. No.: WO2022/239340

PCT Pub. Date: Nov. 17, 2022

(30) Foreign Application Priority Data

May 12, 2021 (JP) ..... 2021-080775

(51) Int. Cl.
*B21D 17/02* (2006.01)
*B21D 5/01* (2006.01)

(52) U.S. Cl.
CPC ..... *B21D 17/02* (2013.01); *B21D 5/01* (2013.01)

(58) Field of Classification Search
CPC ..... B21D 17/02; B21D 5/01
See application file for complete search history.

(56) References Cited

U.S. PATENT DOCUMENTS

2018/0117655 A1 5/2018 Kubo et al.

FOREIGN PATENT DOCUMENTS

| | | | |
|---|---|---|---|
| JP | 2663701 | B2 | 10/1997 |
| JP | 2008-284576 | A | 11/2008 |
| JP | 2013-103226 | A | 5/2013 |
| JP | 6094699 | B2 | 3/2017 |
| JP | 2021-164954 | A | 10/2021 |

OTHER PUBLICATIONS

Apr. 5, 2022 International Search Report issued in International Patent Application No. PCT/JP2022/005594.
Apr. 5, 2022 Written Opinion issued in International Patent Application No. PCT/JP2022/005594.

*Primary Examiner* — Moshe Wilensky
(74) *Attorney, Agent, or Firm* — Oliff PLC

(57) ABSTRACT

A press forming method for a press formed part includes: placing a pre-unbending press formed part on a punch including a top forming surface portion configured to form a top portion of the press formed part, and side-wall forming surface portions configured to form side wall portions, each of the side-wall forming surface portions including a punch side first sloped surface portion, and a punch side second sloped surface portion; relatively moving a die toward the punch, the die including flange unbending portions; and unbending flange portions by the flange unbending portions while punch side ridge line portions are brought into contact with inner surface sides of the side wall portions to form the side wall portions of the press formed part.

4 Claims, 8 Drawing Sheets

(a) FORMING START POSITION (b) POSITION OF BOTTOM DEAD CENTER OF FORMING (a) FORMING START POSITION (b) POSITION OF BOTTOM DEAD CENTER OF FORMING (a) PRE-UNBENDING PRESS FORMED PART (SHALLOW DRAWING)

(b) PRESS FORMED PART HAVING HAT-SHAPED CROSS SECTION (RESTRIKE FORMING)

(a) U-SHAPED CROSS SECTION (b) HAT-SHAPED CROSS SECTION

PRESS FORMING METHOD

FIELD

The present invention relates to a press forming method, and more particularly, to a press forming method in which flange portions of a pre-unbending press forming part, which has a hat-shaped cross section, is unbent to form, by press forming, a press formed part having a high forming height as side wall portions.

BACKGROUND

Many automotive parts are manufactured by press-forming a metal sheet. In recent years, in order to achieve both weight reduction of an automotive body and collision safety, metal sheets having higher strength are adopted as automotive parts. Examples of press formed parts press-formed as such automotive parts include a press formed part 120 having a U-shaped cross section (FIG. 12(*a*)) and a press formed part 130 having a hat-shaped cross section (FIG. 12(*b*)) as illustrated in FIG. 12.

The press formed part 120 having the U-shaped cross section as illustrated in FIG. 12(*a*) as an example includes a top portion 121, side wall portions 123 continuously inclined outward from both ends of the top portion 121 in a range of 1 to 10° with respect to a press forming direction, and punch shoulder parts (shoulder parts of a punch) 125 connecting the top portion 121 and the side wall portions 123. In addition, the press formed part 130 having the hat-shaped cross section as illustrated in FIG. 12(*b*) as an example includes a top portion 131, side wall portions 133 continuously inclined outward with respect to the press forming direction from both ends of the top portion 131, flange portions 135 continuous from lower ends of the side wall portions 133, punch shoulder parts 137 connecting the top portion 131 and the side wall portions 133, and die shoulder parts (shoulder parts of a die) 139 connecting the side wall portions 133 and the flange portions 135.

These press formed parts are manufactured by crash forming (bend forming) or deep drawing (draw forming) and are mainly used as reinforcing members of automobiles, and therefore metal sheets having high strength are used. However, as the strength of a metal sheet is higher, indices indicating formability such as ductility or stretch-flangeability of the material also decrease. For this reason, in particular, in press forming in which a U-shape press formed part having a curved portion concavely curved along a longitudinal direction, such as a substantial L-shape or a substantial T-shape in a top view, is the target shape, side wall portions in the curved portion are likely to result in stretch flange deformation to cause fractures. Furthermore, in a press formed part that is curved in a concave shape along the longitudinal direction and has a hat-shaped cross section, flange portions in the curved portions are pulled in a direction along the curve, which is likely to cause fractures in the flange portions. In addition, as a reaction force for forming the side wall portions curved in the concave shape, a top portion or punch shoulder parts in the curved portion are deformed to shrink in a direction along the curve, and thus wrinkles are likely to be generated.

Meanwhile, in press forming of a press formed part having a U-shaped cross section or a hat-shaped cross section having a curved portion convexly curved along the longitudinal direction in a top view, side wall portions or flange portions in the curved portion are compressed in a direction along the curve to result in shrinkage flanging, and thus wrinkles tend to be easily generated in the side wall portions. In addition, with a reaction force of forming the side wall portions that are convexly curved, the punch shoulder parts are pulled outward along the curve, and thus fractures are likely to be generated.

Therefore, among press formed parts having a U-shaped cross section or a hat-shaped cross section curved in a concave shape or a convex shape in a top view, particularly press formed parts having long side wall portions and a high forming height are generally press-formed in a plurality of steps in order to alleviate tensile stress or compressive stress generated in the press forming process and to prevent generation of fractures or wrinkles.

For example, in a case where the press formed part 120 having the U-shaped cross section illustrated in FIG. 12(*a*) is a target shape, as illustrated in FIG. 3, first, a pre-unbending press formed part 110 having a hat-shaped cross section with short side wall portions 113, namely, with a low forming height, is press-formed (shallow drawing) by a first forming step so as not to generate fractures or wrinkles (FIG. 3(*a*)). Then, in a subsequent second forming step, flange portions 115 of the pre-unbending press formed part 110 is unbent to form the side wall portions 123 having a desired length, and the press formed part 120 having a high forming height is press-formed (restrike forming) (FIG. 3(*b*)).

Similarly, also in a case where the press formed part 130 having the hat-shaped cross section illustrated in FIG. 12(*b*) is the target shape, first, by a first forming step as illustrated in FIG. 11, the pre-unbending press formed part 110 having the hat-shaped cross section having a relatively low forming height is formed (shallow drawing) (FIG. 11(*a*)). Then, in a subsequent second forming step, the flange portions 115 of the pre-unbending press formed part 110 is unbent, and the press formed part 130, in which the side wall portions 133 having the desired length and the flange portions 135 are formed, is press-formed (restrike forming) (FIG. 11(*b*)). In this manner, by performing press forming in a plurality of steps of shallow drawing and restrike forming, the occurrence of fractures or wrinkles in the press formed part is suppressed.

However, the flange portions 115 are not sufficiently unbent to be flat when the flange portions 115 are unbent in the second forming step, and for example, as illustrated in FIG. 13, bending crease portions 127 (or bending crease portions 141), which are local uneven shape defect, remain in the side wall portions 123 (or side wall portions 133). In particular, in a high-tensile steel sheet having a sheet thickness greater than or equal to 1.0 mm exceeding 440 MPa-class, the bending crease portions 127 or 141 remain remarkably.

With such bending crease portions 127 or 141 remaining, there are cases where resistance spot welding is difficult as illustrated in FIG. 14. That is, in the resistance spot welding, a side wall portion 123 of the press formed part 120 or a side wall portion 133 of the press formed part 130 and a flat surface portion 151 of another flat part are overlapped, clamped while a pressure is applied from both sides by electrodes 153, and a large welding current is caused to flow for a short time to form a weld part 155 (weld nugget), thereby joining metals to each other. However, if the bending crease portions 127 and 141 remain in the side wall portions 123 and 133, gaps are generated between the side wall portions 123 and 133 and the flat surface portions 151 which is subjected to weld bonding facing the side wall portions 123 and 133, and in a case where the gaps are larger than a weldable gap, a current (welding current) hardly flows, which caused a problem that welding is difficult. Therefore, it is important to reduce the sizes of the bending crease portions 127 and 141.

In response to such a problem, there is proposed technology of straightening a bending crease portion that remains when a side wall portion having been subjected to a bending process is flattened. For example, Patent Literature 1 discloses technology for straightening a bending crease by, using a punch having three first projection parts arranged side by side at predetermined intervals and a die (die) having two second projection parts arranged so as to face two recessed forming spaces between the three first projection parts, pressing the punch toward the die side in a state where the central first projection part of the three first projection parts abuts from a projecting side of the bending crease and imparting local small deformation to the bending crease by the first projection parts of the punch and the second projection parts of the die.

CITATION LIST

Patent Literature

Patent Literature 1: JP 2013-103226 A

SUMMARY

Technical Problem

However, the technology disclosed in Patent Literature 1 uses a special device for straightening a bending crease generated in a press formed part, and another additional step to straighten the bending crease is required in addition to the forming step of the press formed part, which posed a problem of a decrease in the productivity.

The present invention has been made in view of the above problem, and an object of the present invention is to provide a press forming method capable of reducing the size of the bending crease remaining in side wall portions of a press formed part obtained by unbending flange portions of the pre-unbending press formed part having a hat-shaped cross section to form the side wall portions without requiring a step of straightening the bending crease using a special device.

Solution to Problem

A press forming method according to the present invention is a method for a press formed part in which a pre-unbending press formed part having a hat-shaped cross section is unbent at flange portions using a punch and a die to form side wall portions, the pre-unbending press formed part including: a top portion; the side wall portions continuous from the top portion and inclined with respect to a press forming direction; and the flange portions continuous from the side wall portions via die shoulder parts, wherein the punch includes a top forming surface portion configured to form a top portion of the press formed part having a same shape as a shape of the top portion of the pre-unbending press formed part; and side-wall forming surface portions configured to form the side wall portions, each of the side-wall forming surface portions includes: a punch side first sloped surface portion that is continuous from and inclined outward from the top forming surface portion, the punch side first sloped surface portion having an inclination angle with respect to the press forming direction equal to an inclination angle of a side wall portion of the pre-unbending press formed part; and a punch side second sloped surface portion that is continuous from a lower end of the punch side first sloped surface portion and inclined inward from the punch side first sloped surface portion, the punch side first sloped surface portion and the punch side second sloped surface portion making a chevron shape convex outward, a punch side ridge line portion being formed at a connection portion of the punch side first sloped surface portion and the punch side second sloped surface portion, and the die includes flange unbending portions configured to unbend the flange portions of the pre-unbending press formed part placed on the punch, the press forming method including: placing the pre-unbending press formed part on the punch; relatively moving the die toward the punch; and unbending the flange portions by the flange unbending portions while the punch side ridge line portions are brought into contact with inner surface sides of the side wall portions to form the side wall portions of the press formed part.

The die may have an inner surface shape maintaining a clearance parallel to an outer surface of the punch.

The punch side ridge line portion may be formed at a position satisfying the following inequality:

$$h_1-R_1(1-\sin\alpha)-R_1/2\leq h_2\leq h_1-R_1(1-\sin\alpha)+2\pi R_1(90-\alpha)/360+R_1/2$$

where $h_2$ denotes a distance (mm) in the press forming direction from the top forming surface portion of the punch to the punch side ridge line portion, $h_1$ denotes a forming height (mm) of the pre-unbending press formed part, $R_1$ denotes a bend radius (mm) of a die shoulder part of the pre-unbending press formed part, and a denotes an inclination angle (°) of the side wall portion of the pre-unbending press formed part with respect to the press forming direction.

Advantageous Effects of Invention

In the present invention, when flange portions of a pre-unbending press formed part having a hat-shaped cross section are unbent to form side wall portions by using a punch, having punch side first sloped surface portions, punch side second sloped surface portions, and punch side ridge line portions, and a die having flange unbending portions, the flange portions are unbent by the flange unbending portions of the die while the punch side ridge line portions are brought into contact with inner surface sides of the side wall portions in the pre-unbending press formed part, whereby the size of the bending crease portion can be reduced without adding a step by a special device, and productivity can be improved.

DESCRIPTION OF EMBODIMENTS

Prior to describing a press forming method according to an embodiment of the present invention, studies on a bending crease generation mechanism and a method for reducing a bending crease will be described as a background leading to the present invention.

Bending Crease Generation Mechanism

Figure 3:
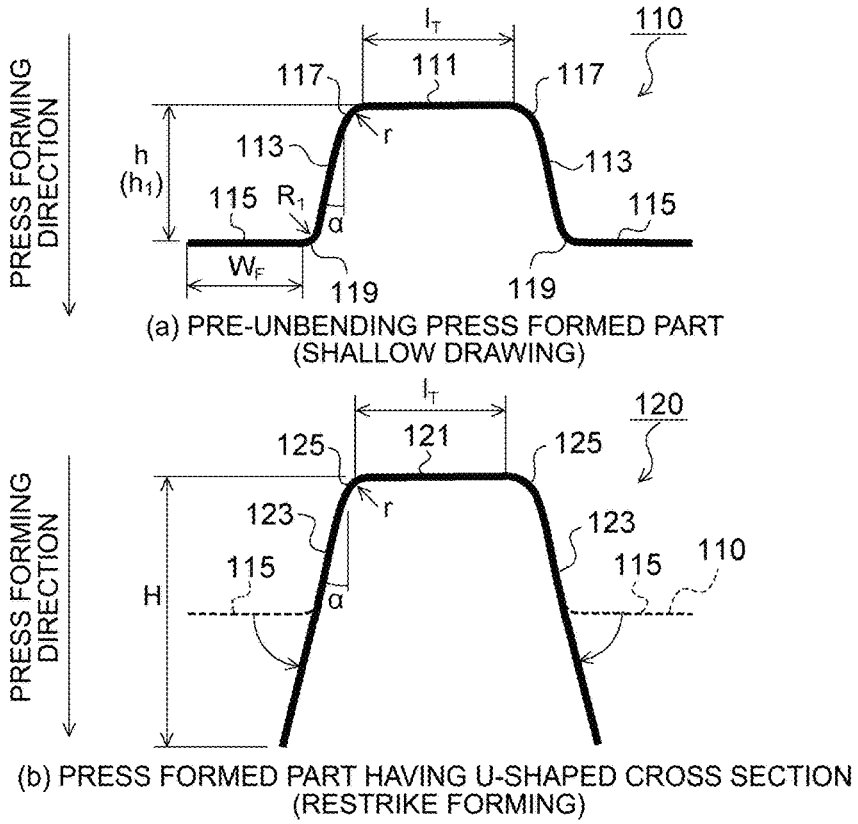
FIG. 3 is a diagram illustrating a pre-unbending press formed part having a hat-shaped cross section and a press formed part having a U-shaped cross section in which flange portions of the pre-unbending press formed part are unbent to form side wall portions that are the subject of the present invention and shapes thereof in an example.
Figure 4:
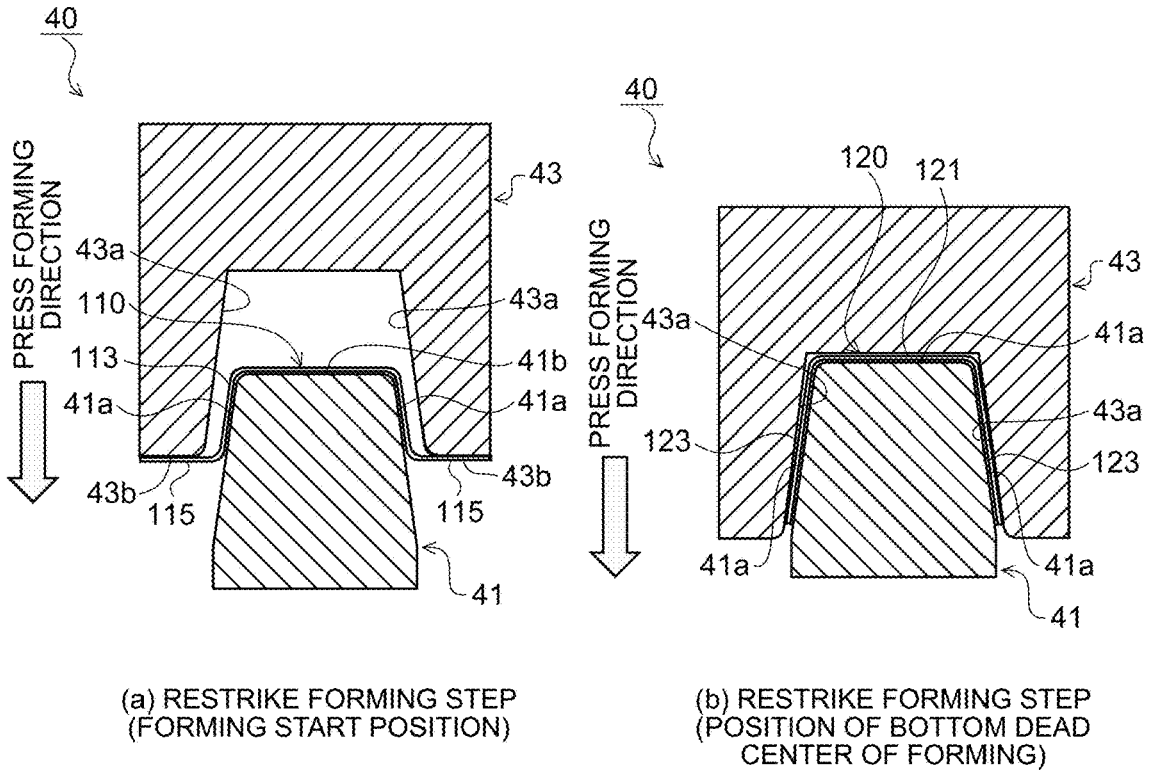
FIG. 4 is a diagram illustrating steps of performing restrike forming on a press formed part having a U-shaped cross section in which the forming height is increased by unbending the flange portions of the pre-unbending press formed part having the hat-shaped cross section in a conventional press forming method ((a) Forming start position and (b) Position of bottom dead center of forming).
Figure 13:
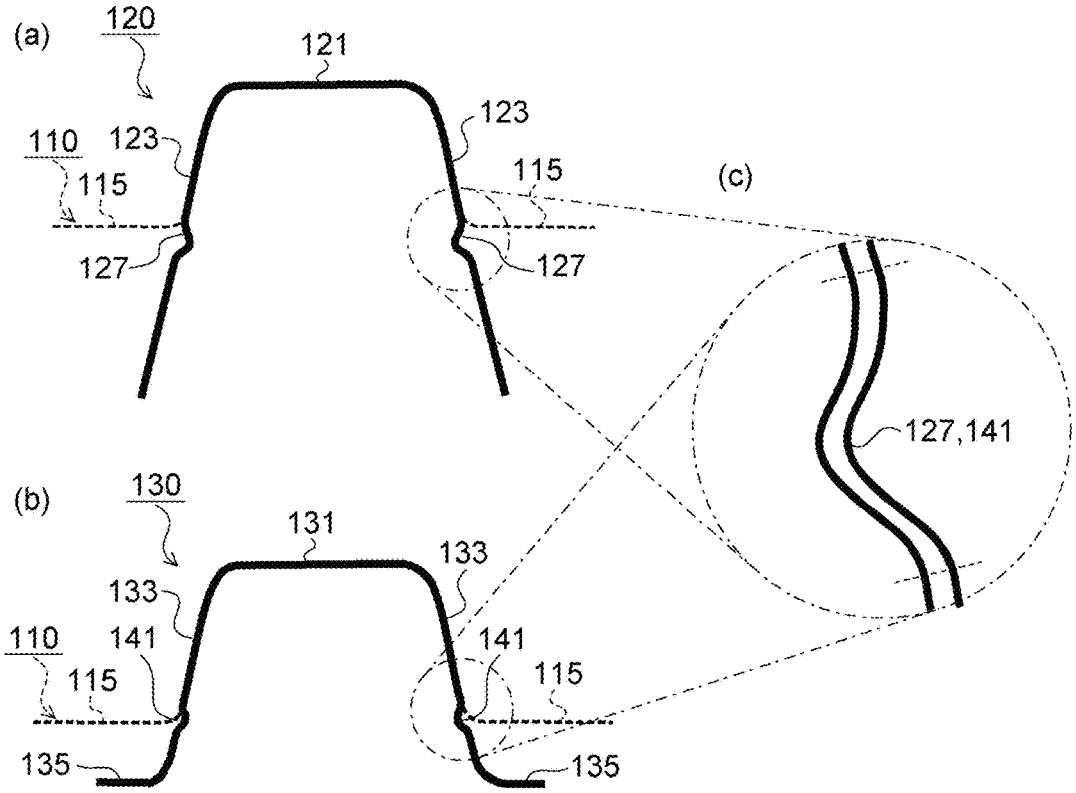
FIG. 13 is a diagram describing a bending crease portion generated in a side wall portion of a press formed part having a U-shaped cross section or a hat-shaped cross section obtained by unbending a flange portion of the pre-unbending press formed part having a low forming height to form the side wall portion ((a) Press formed part having U-shaped cross section, (b) Press formed part having hat-shaped cross section, and (c) Bending crease portion).
Figure 14:
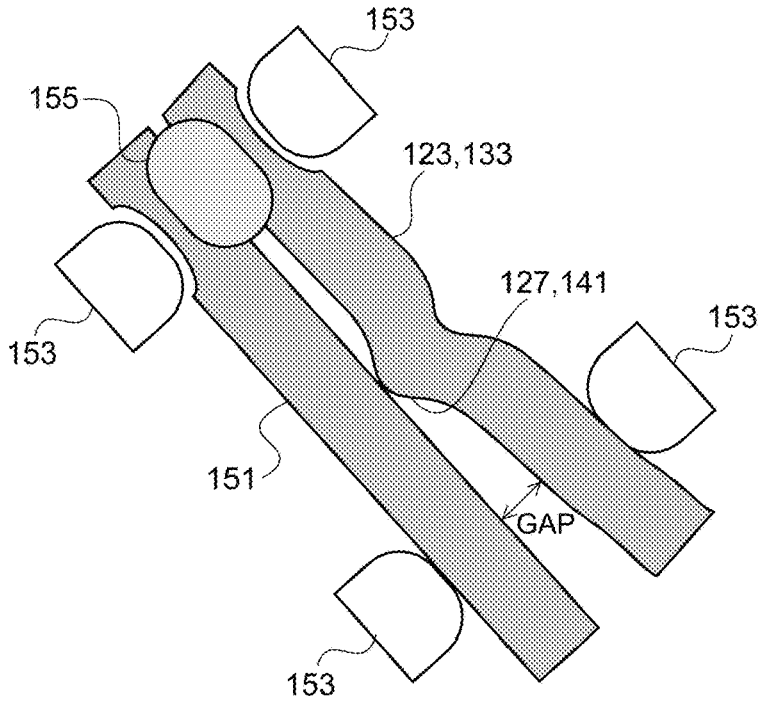
FIG. 14 is a schematic view for explaining a problem in joining a side wall portion of a press formed part having a bending crease and a flat surface portion of another part by resistance spot welding.

The present inventors have studied, using a tool of press forming 40 including a punch 41 and a die 43 as illustrated in FIG. 4, a mechanism in which bending crease portions 127 (see FIG. 13(*a*)) are generated in side wall portions 123 in a process of unbending flange portions 115 of a pre-unbending press formed part 110 having a hat-shaped cross section having a top portion 111, side wall portions 113, and the flange portions 115 as illustrated in FIG. 3(*a*) as an example to obtain a part of side wall portions 123 and re-striking a press formed part 120 thereby obtained as illustrated in FIG. 3(*b*) as an example.

Figure 5:
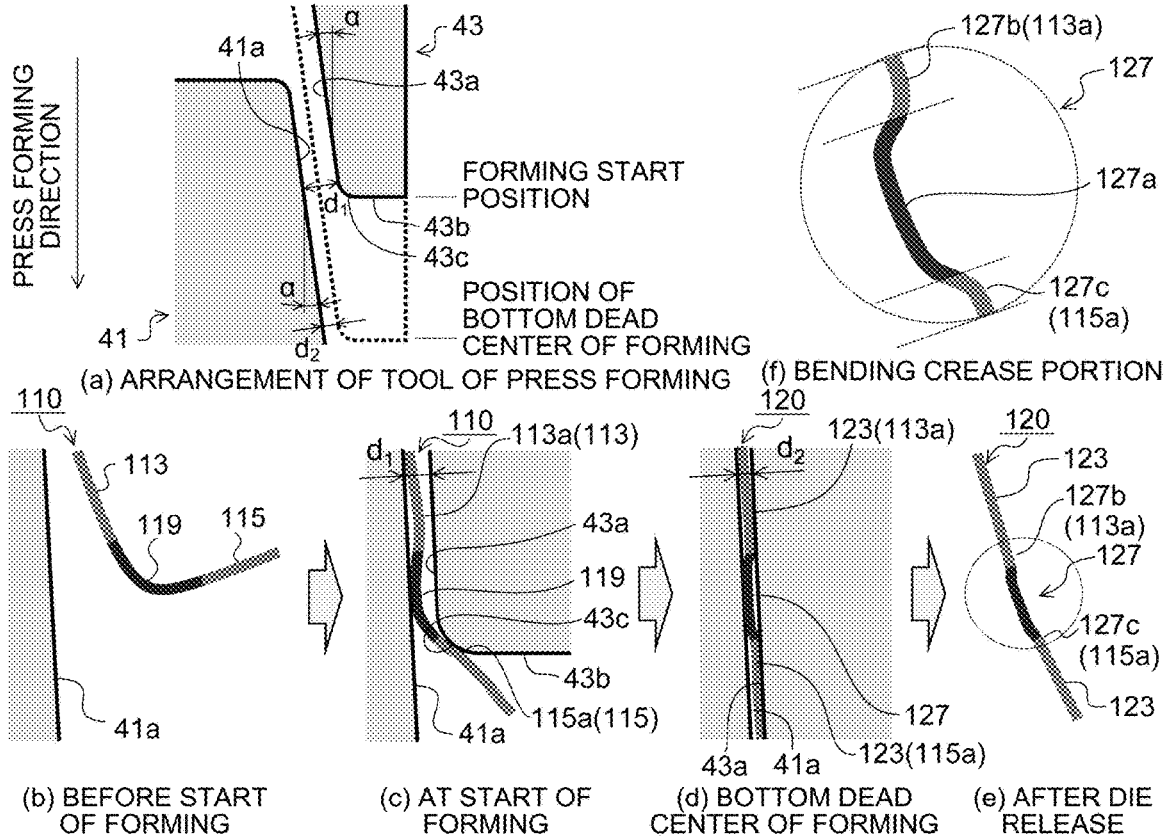
FIG. 5 is a diagram illustrating occurrence of a bending crease portion in a process of performing the restrike forming on the pre-unbending press formed part to form the press formed part ((a) Arrangement of tools of press forming, (b) Before start of forming, (c) At start of forming, (d) Bottom dead center of forming, (e) After die release, and (f) Bending crease portion).

Illustrated in FIG. 5 is the mechanism in which a bending crease portion 127 is generated in a side wall portion 123 of the press formed part 120. Incidentally, FIG. 5(*a*) is a diagram illustrating a relative positional relationship between the punch 41 and the die 43 of the tool of press forming 40, FIGS. 5(*b*) to 5(*d*) are diagrams illustrating deformation behavior of a die shoulder part 119 and its periphery of the pre-unbending press formed part 110 in a forming process from a forming start position to the position of the bottom dead center of forming, FIG. 5(*e*) is a cross sectional view of a side wall portion 123 of the press formed part 120 released from the tool of press forming 40, and FIG. 5(*f*) is an enlarged view illustrating the bending crease portion 127 generated in the side wall portion 123. As illustrated in FIG. 5, in a case where the die 43 is moved in the press forming direction to perform press-forming, the punch 41 and the die 43 are inclined with respect to the press forming direction at the press forming start position, and thus a gap ($d_1$ in FIGS. 5(*a*) and 5(*c*)), which is a distance in the vertical direction between a punch side side-wall forming surface portion 41*a* and a die-side side wall forming surface portion 43*a*, is wider than a gap ($d_2$ in FIGS. 5(*a*) and 5(*d*)) at the time when the position of the bottom dead center of forming is reached.

When a flange unbending portion 43*b* of the die 43 comes into contact with a flange portion 115 of the pre-unbending press formed part 110 to start unbending, as illustrated in FIG. 5(*c*), unbending deformation is started such a manner that the die shoulder part 119 becomes flat.

At this point, since a gap ($d_1$ in FIG. 5(*c*)), which is a distance in the vertical direction between the punch side side-wall forming surface portion 41*a* and the die-side side wall forming surface portion 43*a* in the forming process, is larger than the sheet thickness of the pre-unbending press formed part 110, a space is generated in which the side wall portion 113 and the flange portion 115 of the pre-unbending press formed part 110 can be freely deformed.

Therefore, a reaction force accompanying unbending deformation of the die shoulder part 119 is applied to the side wall portion 113 and the flange portion 115 adjacent to the die shoulder part 119, and plastic bending deformation is applied in a direction opposite to the protruding shape, protruding toward the punch 41, in the die shoulder part 119. Here, regions where plastic bending deformation occurs on the side wall portion 113 side and the flange portion 115 side adjacent to the die shoulder part 119 are referred to as a side wall-side plastic bending deformation region 113*a* and a flange-side plastic bending deformation region 115*a*, respectively.

At the position of the bottom dead center of forming, as illustrated in FIG. 5(*d*), a gap ($d_2$ in FIG. 5(*d*)), which is the distance in the vertical direction between the punch side side-wall forming surface portion 41*a* and the die-side side wall forming surface portion 43*a*, narrows to substantially the same thickness as the sheet thickness of the press formed part 120, and the side wall portion 113 and the flange portion 115 of the pre-unbending press formed part 110 are compressed and formed into a side wall portion 123 of the press formed part 120.

Here, a value (%) obtained by dividing the difference between the gap $d_2$, which is the distance in the vertical direction between the punch side side-wall forming surface portion 41*a* and the die-side side wall forming surface portion 43*a* at the position of the bottom dead center of forming (FIG. 5(*d*)), and the sheet thickness of the side wall portion 123 of the press formed part 120 by the sheet thickness and multiplying the quotient by 100 is defined as a clearance.

At the position of the bottom dead center of forming (FIG. 5(*d*)), in a case where the clearance between the punch side side-wall forming surface portion 41*a* and the die-side side wall forming surface portion 43*a* is made zero, namely, a case where the bending crease portion 127 generated in the side wall portion 123 of the press formed part 120 is pressed by the flat punch side side-wall forming surface portion 41*a* and the die-side side wall forming surface portion 43*a*, it is conceived that the bending crease portion 127 seemingly becomes flat and possible to be straightened.

However, springback occurs as illustrated in FIG. 5(*e*) when the press formed part 120 is released from the tool of press forming 40, and thus the bending crease portion 127 cannot be completely straightened into a flat shape, and the bending crease portion 127, which is a local uneven shape defect, remains in the side wall portion 123. FIG. 5(*f*) is an enlarged view of the bending crease portion 127 remaining in the side wall portion 123 of the press formed part 120 that has been released.

As illustrated in FIG. 5(*f*), in the side wall portion 123 of the press formed part 120 that has been released, a portion corresponding to a shoulder part of the die 127*a* of the pre-unbending press formed part 110, a side wall-side portion receiving plastic bending deformation 127*b* that corresponds to the side wall-side plastic bending deformation region 113*a*, and a flange-side portion receiving plastic bending deformation 127*c* corresponding to the flange-side plastic bending deformation region 115*a* remain as the bending crease portion 127.

Study on Method for Reducing Size of Bending Crease

Based on the above study on the mechanism in which the bending crease portion 127 is generated in the side wall portion 123 of the press formed part 120 obtained by unbending the flange portion 115 of the pre-unbending press formed part 110, the inventors further studied a method of reducing the size (bending crease height) of the bending crease portion 127 generated in the press formed part 120.

Figure 6:
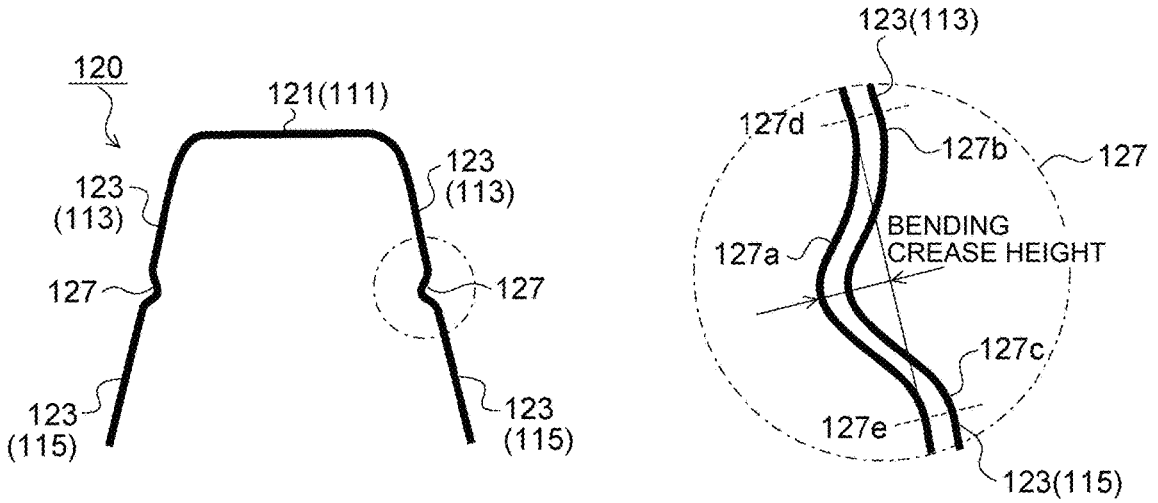
FIG. 6 is a diagram explaining the definition of the bending crease height of a bending crease portion generated in a side wall portion of a press formed part ((a) Cross sectional view of press formed part and (b) Enlarged view of bending crease portion).

Here, as an index for quantitatively evaluating the size of the bending crease portion 127, as illustrated in FIG. 6, the distance in the vertical direction from a straight line, which connects a boundary 127*d* between the side wall portion 123 and the side wall-side portion receiving plastic bending deformation 127*b* on the inner surface side of the press formed part 120 and a boundary 127*e* between the flange-side portion receiving plastic bending deformation 127*c* and the side wall portion 123, to the tip of the convex portion of the bending crease portion 127 is defined as the bending crease height.

As illustrated in FIG. 5(*f*), in the bending crease portion 127, warpage, in a curvature direction (concave toward the punch 41) opposite to warpage in a curvature direction (convex toward the punch 41) of the portion corresponding to the shoulder part of the die 127*a* remaining when the die shoulder part 119 is unbent, is applied to the side wall-side portion receiving plastic bending deformation 127*b* and the flange-side portion receiving plastic bending deformation 127*c*, and since the side wall-side portion receiving plastic bending deformation 127*b* and the flange-side portion receiving plastic bending deformation 127*c* are concave toward the punch 41, it is clear that the bending crease height of the bending crease portion 127 convex toward the punch 41 is increased.

Therefore, on the basis of the result of press forming simulation, the range in which the side wall-side portion receiving plastic bending deformation 127*b* and the flange-side portion receiving plastic bending deformation 127*c* occur was intensively studied. As a result, it has been found that both the side wall-side portion receiving plastic bending deformation 127*b* and the flange-side portion receiving plastic bending deformation 127*c* become wider as a bend radius $R_1$ of the die shoulder part 119 of the pre-unbending press formed part 110 is larger and have a size of about ½ of the bend radius $R_1$ of the die shoulder part 119.

Based on these findings, the inventors have intensively studied a method for reducing the bending crease height of the bending crease portion 127. As a result, it has been found that when the flange portion 115 of the pre-unbending press formed part 110 is unbent, the bending crease height can be reduced by bending the region where the bending crease portion 127 occurs to the side opposite to the bending crease portion 127. The present invention has been completed on the basis of the above study, and the structure thereof will be described below.

Press Forming Method

Figure 1:
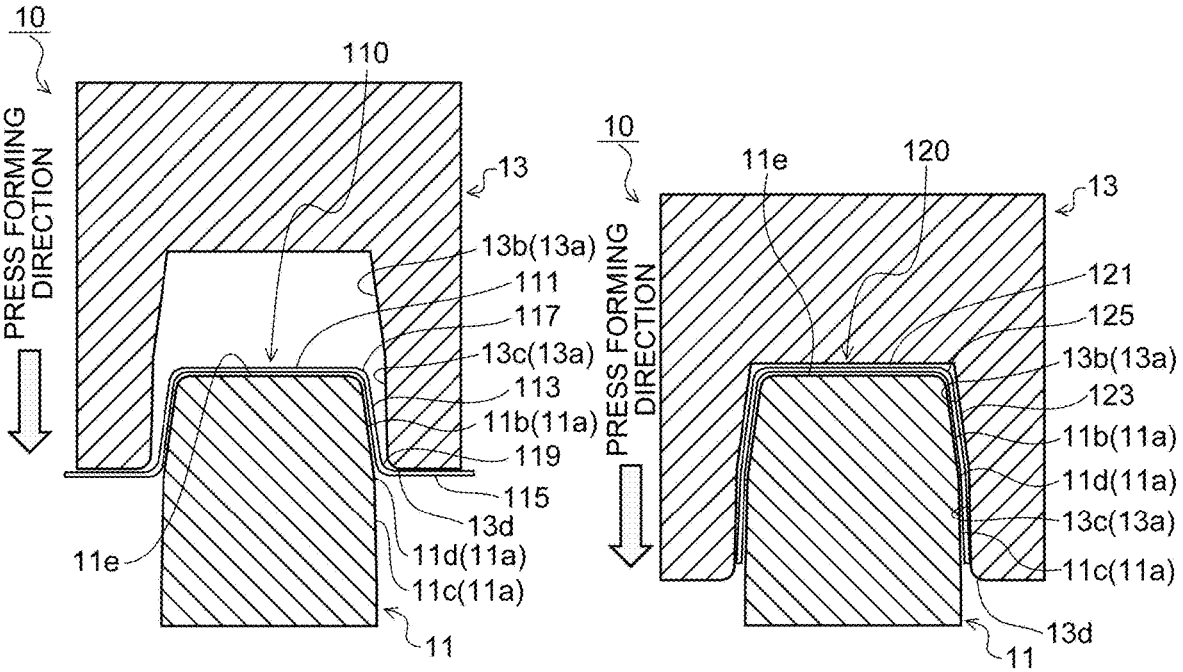
FIG. 1 is a diagram illustrating a press forming method according to an embodiment of the present invention ((a) Forming start position, (b) Position of bottom dead center of forming).
Figure 2:
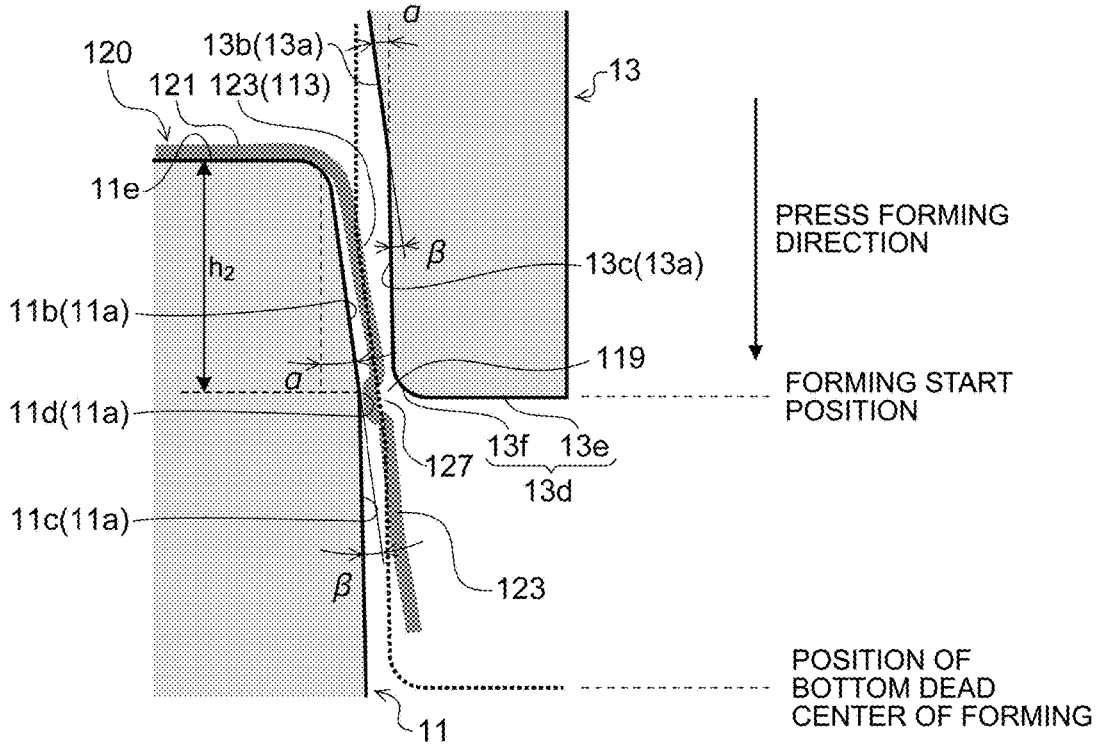
FIG. 2 is a diagram illustrating a positional relationship between a tool of press forming used in the press forming method according to the embodiment of the present invention and a bending crease portion generated in a side wall portion.

In the press forming method according to the embodiment of the present invention, as illustrated in FIG. 3(*a*), a pre-unbending press formed part 110 having a hat-shaped cross section including a top portion 111, side wall portions 113 continuous from the top portion 111 and inclined with respect to a press forming direction, and flange portions 115 continuous from the side wall portions 113 via die shoulder parts 119 is unbent at the flange portions 115 using a tool of press forming 10 including a punch 11 and a die 13 as illustrated as an example in FIGS. 1 and 2, thereby press-forming a press formed part 120 in which side wall portions 123 as illustrated as an example in FIG. 3(*b*) are formed.

In the pre-unbending press formed part 110, a punch shoulder part 117 connecting the top portion 111 and a side wall portion 113 and a die shoulder part 119 connecting the side wall portion 113 and a flange portion 115 are formed.

Meanwhile, in the press formed part 120, a punch shoulder part 125 connecting a top portion 121 and a side wall portion 123 is formed. Here, the top portion 121 and the punch shoulder part 125 have the same shape as that of the top portion 111 and the punch shoulder part 117 of the pre-unbending press formed part 110, respectively. Furthermore, an inclination angle $\alpha$ of the side wall portion 113 of the pre-unbending press formed part 110 with respect to the press forming direction is equal to an inclination angle $\alpha$ of the side wall portion 123 of the press formed part 120.

As illustrated in FIG. 1, the punch 11 has a top forming surface portion lie and punch side side-wall forming surface portions 11*a*.

The top forming surface portion lie forms the top portion 121 having the same shape as the top portion 111 of the pre-unbending press formed part 110.

A punch side side-wall forming surface portion 11*a* forms a side wall portion 113 of the pre-unbending press formed part 110 and has a punch side first sloped surface portion lib, a punch side second sloped surface portion 11*c*, and a punch side ridge line portion 11*d* as illustrated in FIG. 1. Note that the punch side side-wall forming surface portion 11*a* corresponds to the "side-wall forming surface portion" described in the claims of the present application.

As illustrated in FIG. 2, the punch side first sloped surface portion 11*b* is continuously inclined outward from the top forming surface portion lie, and the inclination angle with respect to the press forming direction is equal to the inclination angle $\alpha$ with respect to the press forming direction of the side wall portion 113 of the pre-unbending press formed part 110.

As illustrated in FIG. 2, the punch side second sloped surface portion 11*c* is continuous from the lower end of the punch side first sloped surface portion 11*b* and inclined inward with respect to the punch side first sloped surface portion 11*b*. In the present embodiment, as illustrated in FIG. 2, the punch side second sloped surface portion 11*c* is inclined inward at an inclination angle $\beta$ ($0<\beta\leq\alpha$) to the punch 11 side with the punch side first sloped surface portion 11*b* used as a reference.

As illustrated in FIG. 1, the punch side ridge line portion 11*d* is formed at a connection portion between the punch side first sloped surface portion 11*b* and the punch side second sloped surface portion 11*c*. As a result, the punch side side-wall forming surface portion 11*a* has a chevron shape in which the punch side first sloped surface portion 11*b* and the punch side second sloped surface portion 11*c* are convex outward of the punch 11.

As illustrated in FIG. 1, the die 13 is disposed to face the punch 11 and has die-side side wall forming surface portions 13*a* and flange unbending portions 13*d*.

The die-side side wall forming surface portion 13*a* forms the side wall portion 113 of the pre-unbending press formed part 110 in cooperation with the punch side side-wall forming surface portion 11*a* and has a die-side first sloped surface portion 13*b* and a die-side second sloped surface portion 13*c* as illustrated in FIG. 1.

As illustrated in FIG. 2, the die-side first sloped surface portion 13*b* is inclined at an inclination angle $\alpha$ with respect to the press forming direction and is parallel to the punch side first sloped surface portion 11*b*.

As illustrated in FIG. 2, the die-side second sloped surface portion 13*c* is inclined and continuous from the lower end of the die-side first sloped surface portion 13*b* toward the punch 11 with respect to the press forming direction. In the present embodiment, as illustrated in FIG. 2, the die-side second sloped surface portion 13*c* is inclined by an inclination angle $\beta$ ($0<\beta\leq\alpha$) toward the punch 11 with respect to the die-side first sloped surface portion 13*b* and is parallel to the punch side second sloped surface portion 11*c*.

A flange unbending portion 13*d* is continuous from the die-side second sloped surface portion 13*c* and abuts on and unbend the flange portion 115 of the pre-unbending press formed part 110 placed on the punch 11. In the present embodiment, as illustrated in FIG. 2, the flange unbending portion 13*d* has a flange forming surface portion 13*e* for forming the flange portion 115 and a die shoulder part 13*f* connected with the flange forming surface portion 13*e*.

Then, the pre-unbending press formed part 110 is placed on the punch 11, the die 13 is moved relatively toward the punch 11, and the entire or a part of the flange portions 115 is unbent by the flange unbending portions 13*d* of the die 13 while the punch side ridge line portions 11*d* of the punch 11 are in contact with the inner surface of the side wall portions 113 to form the side wall portions 123 of the press formed part 120. At this point, the top portion 121 is formed in the same shape as that of the top portion 111 of the pre-unbending press formed part 110.

As illustrated in FIG. 2, the punch side ridge line portion 11*d* of the punch 11 is preferably set so as to abut on the die shoulder part 119 or the side wall-side plastic bending deformation region 113*a* or the flange-side plastic bending deformation region 115*a* (see FIG. 5(*c*)) of the pre-unbending press formed part 110, which corresponds to the region where the bending crease portion 127 occurs in the side wall portion 123 of the press formed part 120.

Then, as illustrated in FIG. 1(*b*), the die 13 is moved relatively toward the punch 11 side, and as illustrated in FIG. 2, the flange portions 115 are unbent while the punch side ridge line portion 11*d* of the punch 11 is brought into contact with the inside of the region (127*a*, 127*b*, and 127*c* in FIG. 5(*f*)) where the bending crease portion 127 occurs in the side wall portion 123 of the press formed part 120.

Reason why Size of Bending Crease can be Reduced

Next, the reason why the size of the bending crease portion 127 generated in the side wall portion 123 of the press formed part 120 can be reduced by the press forming method according to the present embodiment will be described.

Figure 7:
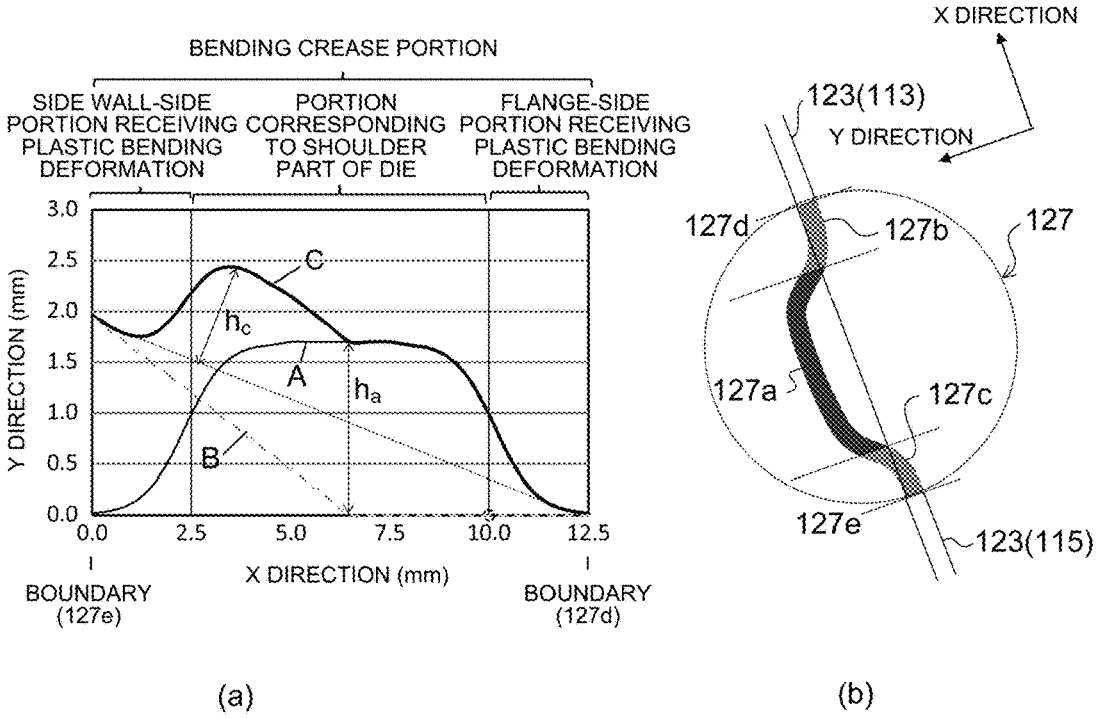
FIG. 7 is a diagram explaining the bending crease height of the bending crease portion generated in the side wall portion of the press formed part in the press forming method according to the present embodiment ((a) Surface shape profile of bending crease portion and (b) Enlarged view of bending crease portion).

FIG. 7 is a diagram illustrating a profile of the surface shape of the side wall portion 123 of the press formed part 120 on the punch 11 side. The horizontal axis indicates the position in a direction (X direction) from the lower end to the upper end of the side wall portion 123 of the press formed part 120, and the vertical axis indicates the distance (surface shape profile) from the surface of the side wall portion 123 on the punch 11 side to the surface of the bending crease portion 127 in a direction (Y direction) perpendicular to the side wall portion 123.

A in FIG. 7(*a*) indicates the surface shape profile on the punch 41 side of the bending crease portion 127 of the press formed part 120 obtained by unbending and press-forming the flange portion 115 of the pre-unbending press formed part 110 by the conventional tool of press forming 40 (FIG. 4), and the bending crease height is the maximum value of the distance to the surface of the bending crease portion 127 in the direction perpendicular to the side wall portion 123 ($h_a$ in FIG. 7(*a*)).

B in FIG. 7(*a*) indicates the surface shape profile of the bending crease portion 127 on the punch 11 side in a case where the bending crease portion 127 is not generated in the side wall portion 123 of the press formed part 120 obtained by press-forming using the tool of press forming 10 according to the present embodiment. C in FIG. 7(*a*) indicates the surface shape profile on the punch 11 side of the bending crease portion 127 generated in the side wall portion 123 of the press formed part 120 obtained by press-forming using the tool of press forming 10 according to the present embodiment, which is obtained by synthesizing the surface shape profile A and the surface shape profile B.

A bending crease height $h_e$ in the surface shape profile C is the maximum value ($h_e$ in FIG. 7(*a*)) of the distance in the vertical direction from a virtual straight line (dotted line in FIG. 7(*a*)) connecting both ends of the bending crease portion 127 (the boundary 127*d* between the region where the bending crease portion 127 occurs and the portion of the side wall portion 123 corresponding to the side wall portion 113 and the boundary 127*e* between the region where the bending crease portion 127 occurs and the portion corresponding to the flange portion 115 in FIG. 7(*b*)) according to the definition of the bending crease height illustrated in FIG. 6(*b*) and is lower than the bending crease height $h_a$ ($h_a$ in FIG. 7(*a*)) of the surface shape profile A obtained when the conventional punch 31 is used.

As described above, according to the press forming method of the present embodiment, the flange portion 115 is unbent while the punch side ridge line portion 11*d* is brought into contact with the region (between the boundary 127*d* and the boundary 127*e* in FIGS. 6(*b*), 7(*a*), and 7(*b*)) where the bending crease portion 127 occurs in the pre-unbending press formed part 110, whereby the surface shape profile of the bending crease portion 127 can be changed by bending concavely toward the punch 11 side, and the bending crease height of the bending crease portion 127 can be reduced.

Suitable Position of Punch Side Ridge Line Portion in Punch

Figure 8:
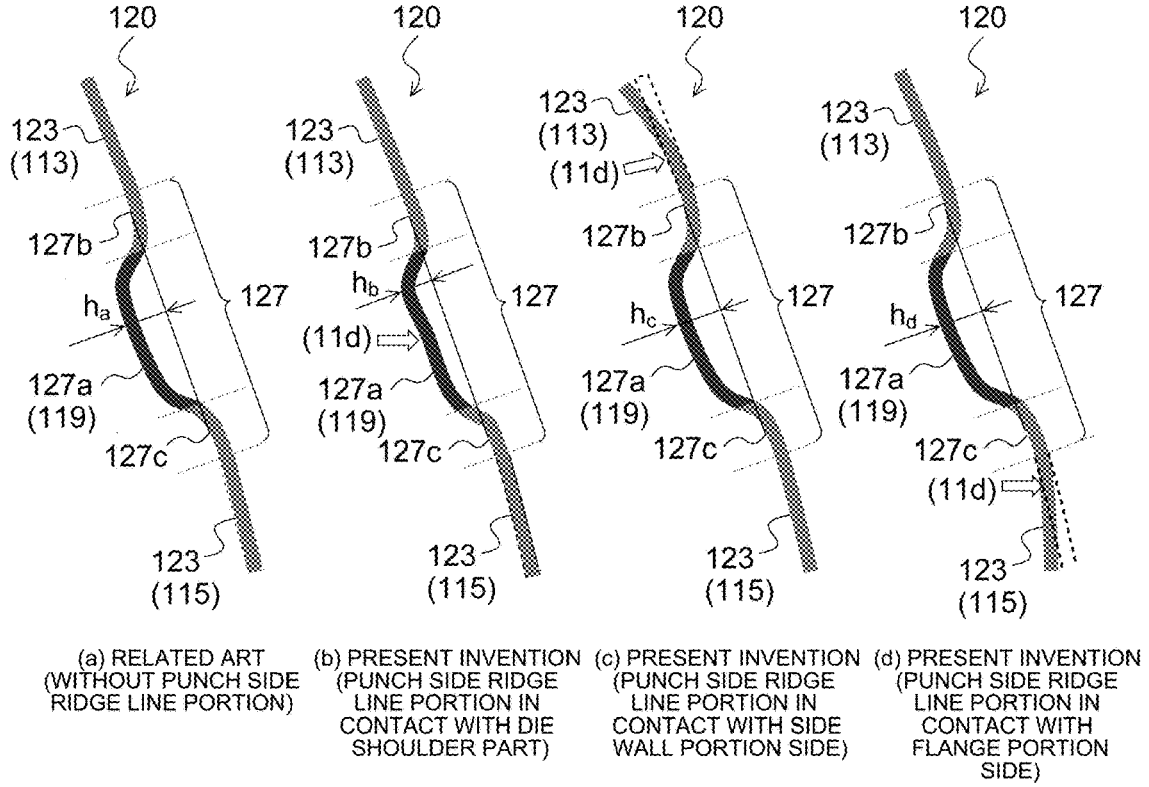
FIG. 8 is a view schematically illustrating the cross section of the side wall portion of the press formed part in cases where the position of a punch side ridge line portion is changed in the press forming method according to the present embodiment ((a) Conventional method, (b) Punch side ridge line portion is brought into contact with die shoulder part in present invention (11*d*), (c) Punch side ridge line portion is brought into contact with side wall portion side of bending crease portion (11*d*), and (d) Punch side ridge line portion is brought into contact with flange portion side of bending crease portion in present invention (11*d*)).

FIG. 8 is a diagram schematically illustrating a cross sectional shape of the side wall portion 123 of the press formed part 120 when the position (11*d*) of the punch side ridge line portion 11*d* of the punch 11 used in the press forming method according to the present embodiment is changed. Here, FIG. 8(*a*) is a diagram illustrating a case where the conventional punch 41 is used, FIG. 8(*b*) is a diagram illustrating a case where the punch side ridge line portion 11*d* of the punch 11 is brought into contact with the die shoulder part 119, and FIGS. 8(*c*) and 8(*d*) are diagrams illustrating cases where the punch side ridge line portion 11*d* is brought into contact with the outside of the region where the bending crease portion 127 is generated, and a white arrow in FIGS. 8(*b*) to 8(*d*) indicates a position where the punch side ridge line portion 11*d* is brought into contact.

Comparing the surface shape profiles of the bending crease portion 127 in the case of using the punch 11 (see FIG. 1) of the present embodiment and in the case of using the conventional punch 41 (see FIG. 4), as illustrated in FIGS. 8(*a*) and 8(*b*), the bending crease height of the bending crease portion 127 is reduced ($h_a > h_b$).

Furthermore, in a case where the position at which the punch side ridge line portion 11*d* of the punch 11 abuts is set to the side of the side wall portion 113 or on the side of the flange portion 115, which is outside of the region where the bending crease portion 127 occurs, as illustrated in FIGS. 8(*c*) and 8(*d*), the bending crease height is higher as compared with the case where the punch side ridge line portion 11*d* is located in the region where the bending crease portion 127 occurs (FIG. 8(*b*)), and the bending crease height is not improved as compared with the case where the conventional punch 41 is used (FIG. 8(*a*)).

From the results of FIGS. 8(*b*) to 8(*d*), it can be understood that there is a suitable position for reducing the size of the bending crease portion 127 for the punch side ridge line portion 11*d* included in the punch 11. Therefore, a preferred position of the punch side ridge line portion 11*d* will be described on the basis of FIG. 9.

Figure 9:
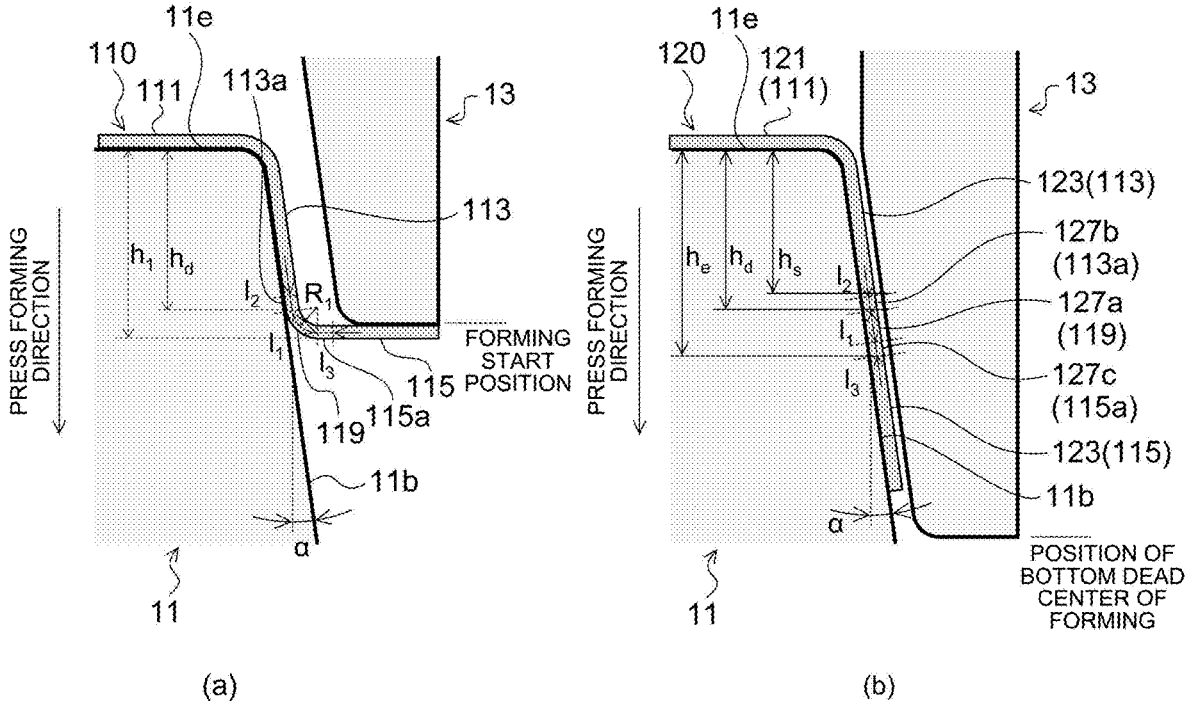
FIG. 9 is a diagram illustrating a suitable position of the punch side ridge line portion in the press forming method according to the present embodiment ((a) Forming start position and (b) Position of bottom dead center of forming).

FIG. 9(*a*) is a diagram schematically illustrating the region where the bending crease portion 127 is generated when the flange portion 115 of the pre-unbending press formed part 110 is unbent.

A length $\mathbf{1}_1$ (see FIG. 9(*a*)) of the region of the die shoulder part 119 of the pre-unbending press formed part 110 can be calculated by Equation (1) from the geometric relationship between the inclination angle α (°) of the side wall portion 113 with respect to the press forming direction and the bend radius $R_1$ of the die shoulder part 119.

$$\mathbf{1}_1 = 2\pi R_1 \times (90° - \alpha)/360° \quad \text{Equation (1)}$$

In addition, a length $\mathbf{1}_2$ of the side wall-side plastic bending deformation region 113*a* in the side wall portion 113 of the pre-unbending press formed part 110 and a length $\mathbf{1}_3$ of the flange-side plastic bending deformation region 115*a* in the flange portion 115 are approximately ½ of the bend radius $R_1$ of the die shoulder part 119 of the pre-unbending press formed part 110 as described above regarding the bending crease generation mechanism and thus are given by Equations (2) and (3).

$$\mathbf{1}_2 = R_1 \times ½ \quad \text{Equation (2)}$$

$$\mathbf{1}_3 = R_1 \times ½ \quad \text{Equation (3)}$$

From these, the length of the region where the bending crease portion 127 occurs can be calculated as the total value of the length $\mathbf{1}_1$ of the die shoulder part 119, the length $\mathbf{1}_2$ of the side wall-side plastic bending deformation region 113*a*, and the length $\mathbf{1}_3$ of the flange-side plastic bending deformation region 115*a* of the pre-unbending press formed part 110.

For example, in a case where the bend radius $R_1$ of the die shoulder part 119 is 5 mm and the inclination angle α with respect to the press forming direction of the side wall portion 113 of the pre-unbending press formed part 110 is 3°, the length $\mathbf{1}_1$ of the die shoulder part 119 is 7.6 mm from Equation (1), and the length $\mathbf{1}_2$ of the side wall-side plastic bending deformation region 113*a* and the length $\mathbf{1}_3$ of the flange-side plastic bending deformation region 115*a* are both 2.5 mm from Equations (2) and (3). In this case, the length of the region where the bending crease portion 127 occurs in the pre-unbending press formed part 110 is given by the sum of these values, which is 12.6 mm (=7.6 mm+2.5 mm+2.5 m).

Let the inclination angle of the punch side first sloped surface portion lib be the same as the inclination angle α of the side wall portion 113 of the pre-unbending press formed part 110, and let the forming height of the pre-unbending press formed part 110 be $h_1$, then a distance $h_d$ from the top forming surface portion lie in the press forming direction at the boundary between the die shoulder part 119 and the side wall-side plastic bending deformation region 113*a* is given, from the geometrical relationship illustrated in FIG. 9(*a*), by $$h_d = h_1 - R_1 \cdot (1 - \sin\alpha) \quad \text{Equation (4).}$$

FIG. 9(*b*) is a diagram illustrating the position of the region where the bending crease portion 127 occurs and the boundaries thereof with the top portion 111 of the pre-unbending press formed part 110 used as a reference. In a case where the inclination angle α of the side wall portion 113 of the pre-unbending press formed part 110 is within a range of 1 to 10°, the angle can be approximated as cos α≈1, and thus a distance $h_s$ from the top portion 111 to the boundary on the side wall portion 113 side and a distance $h_e$ from the top portion 111 to the boundary on the flange portion 115 side in the press forming direction are given by Equations (5) and (6), respectively, using Equations (1) to (4).

$$h_s = h_1 - R_1 \cdot (1 - \sin\alpha) - R_1 \times 1/2 \quad \text{Equation (5)}$$

$$h_e = h_1 - R_1 \cdot (1 - \sin\alpha) + 2\pi R_1 \times (90° - \alpha)/360° + R_1 \times 1/2 \quad \text{Equation (6)}$$

Therefore, let $h_2$ be a distance from the top forming surface portion lie in the press forming direction of the punch side ridge line portion 11*d* (see FIG. 2), and by determining the position of the punch side ridge line portion 11*d* so as to satisfy $h_s \le h_2 \le h_e$, namely, the following Inequality (7), it becomes possible to unbend the flange portion 115 of the pre-unbending press formed part 110 while the punch side ridge line portion 11*d* is brought into contact with the inner surface side of the side wall portion 113 in the region where the bending crease portion 127 occurs, and thus the region where the bending crease portion 127 occurs can be steeply bent to further reduce the bending crease height, which is preferable.

$$h_1 - R_1(1 - \sin\alpha) - R_1/2 \le h_2 \le h_1 - R_1(1 - \sin\alpha) + 2\pi R_1(90 - \alpha)/360 + R_1/2 \text{Inequality} \quad (7)$$

Here, $h_2$ represents a distance (mm) in the press forming direction from the top forming surface portion lie of the punch 11 to the punch side ridge line portion 11*d*, $h_1$ represents a forming height (mm) of the pre-unbending press formed part 110 (see FIG. 3), $R_1$ represents a bend radius (mm) of the die shoulder part 119 of the pre-unbending press formed part 110 (see FIG. 3), and a represents an inclination angle (°) (see FIG. 3) of the side wall portion 113 of the pre-unbending press formed part 110 with respect to the press forming direction.

Inclination Angle of Punch Side Second Sloped Surface Portion

Figure 10:
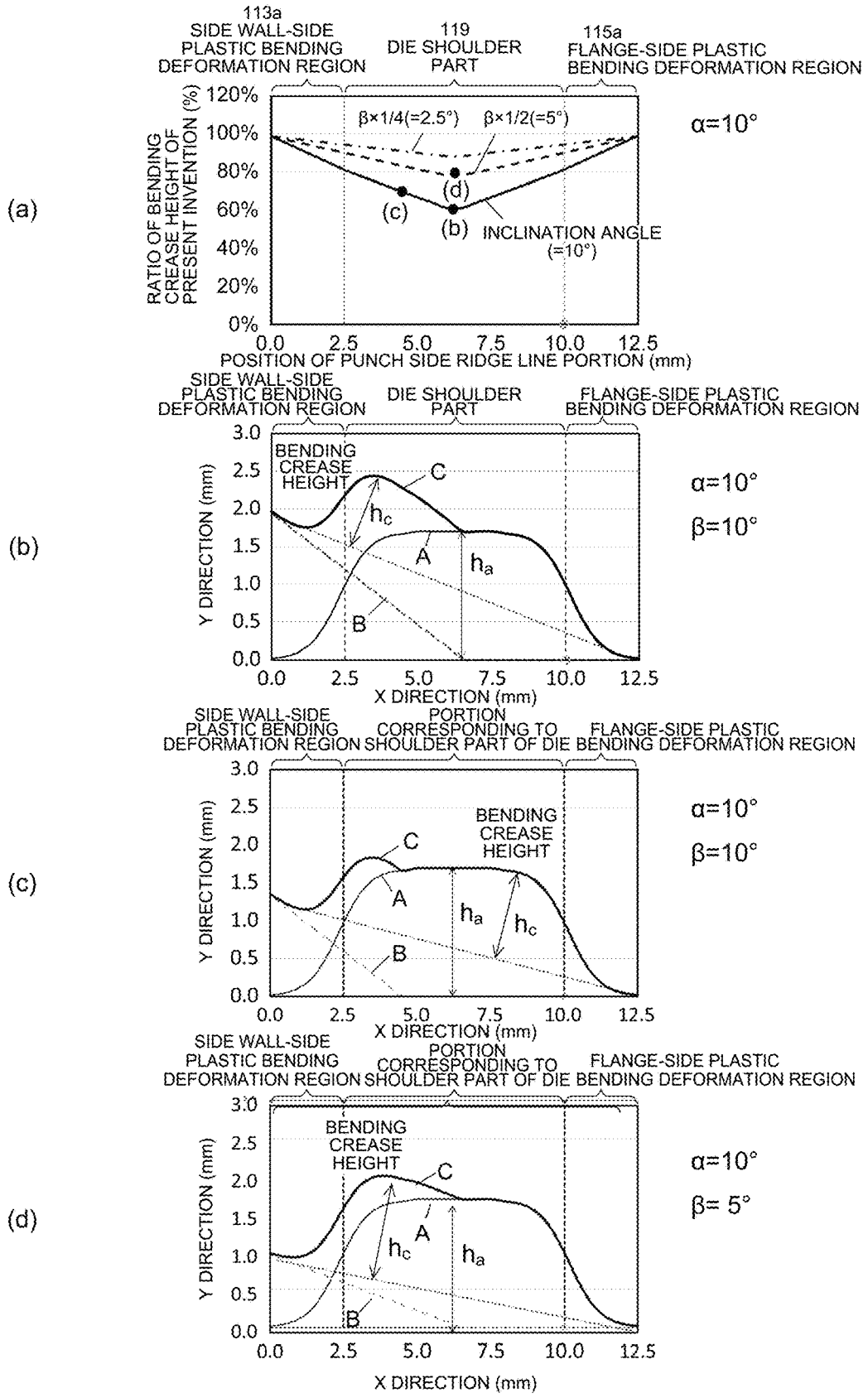
FIG. 10 includes graphs illustrating the surface shape profile of the bending crease portion when the position of the punch side ridge line portion and an inclination angle β (FIG. 2) of a punch side second sloped surface portion are changed in the press forming method according to the embodiment ((a) Ratio of bending crease height in the invention with the bending crease height generated in the conventional method used as a reference, (b) Surface shape profile of bending crease portion when punch side ridge line portion is brought into contact with die shoulder part in the invention, (c) Surface shape profile of bending crease portion when punch side ridge line portion is brought into contact with side wall-side plastic bending deformation region in the invention, and (d) Surface shape profile of bending crease portion when punch side ridge line portion is brought into contact with flange-side plastic bending deformation region in the invention).

FIG. 10(*a*) is a graph presenting the bending crease height, in cases where the position of the punch side ridge line portion 11*d* is changed within the side wall-side plastic bending deformation region 113*a*, the die shoulder part 119, and the flange-side plastic bending deformation region 115*a* where the bending crease portion occurs in the case where the inclination angle α of the punch side first sloped surface portion lib with respect to the press forming direction is set to 10°, the inclination angle β of the punch side second sloped surface portion 11*c* is set to 10°, and β×½ (=5°) and β×¼ (=2.5°) hold, the bending crease height represented as a ratio by setting the bending crease height $h_a$ (see the surface shape profile A in FIG. 7(*a*)) of the bending crease portion 127 in the press formed part 120 obtained by press-forming using the conventional punch 41 to 100%. FIGS. 10(*b*) to 10(*d*) are graphs presenting surface shape profiles on the punch side of the bending crease portion 127 of plots (b) to (d) in FIG. 10(*a*). The horizontal axis (X direction), the vertical axis (Y direction), A, B, and C in FIGS. 10(*b*) to 10(*d*) are similar to those in FIG. 7 described above.

As can be seen from FIG. 10(*a*), the bending crease height can be reduced by positioning the punch side ridge line portion 11*d* in the region where the bending crease portion occurs (113*a*, 119, and 115*a*), and the bending crease height is the lowest when the punch side ridge line portion 11*d* is positioned at the center of the region where the bending crease portion occurs (see the surface shape profile C illustrated in FIGS. 10(*b*) and 10(*c*)).

From FIG. 10(*a*), it is understood that the effect of reducing the apparent bending crease height is improved by increasing the inclination angle β of the punch side second sloped surface portion 11*c* (see the surface shape profile C illustrated in FIGS. 10(*b*) and 10(*d*)). Therefore, in order to reduce the bending crease height, it is preferable to increase the inclination angle β of the punch side second sloped surface portion 11*c*.

However, in a case where the inclination angle β of the punch side second sloped surface portion 11*c* is made larger than the inclination angle α of the punch side first sloped surface portion 11*b*, the punch side second sloped surface portion 11*c* is closer to the top forming surface portion lie than the punch side ridge line portion 11*d* is. Therefore, in a case where the die 13 of the tool of press forming 10 is relatively moved in parallel to the press forming direction, the gap in the vertical direction between the punch side second sloped surface portion 11*c* and the die-side second sloped surface portion 13*c* at the position of the bottom dead center of forming becomes wide, and the flange portion 115 to be unbent cannot be sufficiently restrained, and thus the effect of reducing the bending crease height of the bending crease portion 127 is also saturated.

Therefore, in the case where the die 13 is relatively moved in parallel to the press forming direction toward the punch 11, the inclination angle β of the punch side second sloped surface portion 11*c* is only required to be less than or equal to the inclination angle α of the punch side first sloped surface portion 11*b* (0<β≤α).

However, in a case of performing insert bending using the tool of press forming 10 including a mechanism in which the die 13 is inclined with respect to the press forming direction and moves toward the punch 11, there is no upper limit as described above for the inclination angle β of the punch side second sloped surface portion 11*c*, and the inclination angle β may be set as appropriate.

When the press formed part 120 is released from the tool of press forming 10 after the press-forming, the side wall portion 123 formed by unbending the flange portion 115 springs back to be convex toward the punch 11 (see FIG. 5(*e*)). Therefore, the inclination angle β of the punch side second sloped surface portion 11*c* is preferably kept within a range in which the bending amount (concave shape toward the punch 11) of the side wall portion 123 of the press formed part 120 in the press forming process does not exceed the springback amount (convex shape toward the punch 11).

However, the springback amount of the side wall portion 123 after the release is affected by various factors such as the cross sectional shape and the shape in the longitudinal direction of the press formed part 120, the tensile strength and the sheet thickness of a metal sheet used for a blank 100, and the distribution of the residual stress or strain generated in the press formed part 120, and thus the springback amount cannot be uniformly determined. Therefore, the springback amount of the side wall portion 123 is preferably obtained in advance by numerical simulation by a finite element method or a preliminary experiment.

In addition, the die 13 preferably has an inner surface shape maintaining a clearance parallel to the outer surface of the punch 11. Here, the inner surface shape of the die 13 refers to the shapes of the die-side first sloped surface portion 13*b* and the die-side second sloped surface portion 13*c*. Incidentally, the outer surface of the punch 11 refers to the shapes of the punch side first sloped surface portion 11*b* and the punch side second sloped surface portion 11*c*. It is further preferable that the die-side first sloped surface portion 13*b* of the die 13 is inclined at the inclination angle $\alpha$ with respect to the press forming direction and is parallel to the punch side first sloped surface portion 11*b* and that the die-side second sloped surface portion 13*c* is inclined at the inclination angle $\beta$ toward the punch 11 with respect to the die-side first sloped surface portion 13*b* and is parallel to the punch side second sloped surface portion 11*c*.

Then, at the position of the bottom dead center of forming where the die 13 is moved relatively and in parallel with the press forming direction to approach the punch 11, the die-side first sloped surface portion 13*b* and the die-side second sloped surface portion 13*c* are preferably provided in such a manner as to face the punch side first sloped surface portion 11*b* and the punch side second sloped surface portion 11*c* with distances in the vertical direction thereto having a predetermined gap. This is because, as in the state of the position of the bottom dead center of forming illustrated in FIG. 1(*b*), the space in which the side wall portion 113 can be freely deformed between the punch 11 and the die 13 can be narrowed to restrain the side wall portion 113, and thus the shapes of the punch side first sloped surface portion 11*b* and the punch side second sloped surface portion 11*c* and the shapes of the die-side first sloped surface portion 13*b* and the die-side second sloped surface portion 13*c* can be easily transferred.

Clearance Between Punch and Die

Here, in the tool of press forming 10 illustrated in FIGS. 1 and 2, the punch 11 and the die 13 are preferably installed in such a manner that the clearance between the punch 11 and the die 13 is within a range of 0% to 50% of the sheet thickness of the blank. The clearance between the punch 11 and the die 13 refers to a value (%) calculated by dividing the distance in the vertical direction between the punch side first sloped surface portion and the die-side first sloped surface portion or the distance in the vertical direction between the punch side second sloped surface portion and the die-side second sloped surface portion by the sheet thickness and multiplying the quotient by 100.

In a case where the clearance is less than 0%, so-called "ironing" occurs, and abnormal sliding wear of a sliding surface or a flaw called "galling" may occur, which is not preferable. Alternatively, in a case where the clearance exceeds 50%, a space where the blank can move freely is generated, thereby making it difficult for the effect of the present invention to be exerted, which is not preferable.

In particular, in a case where a metal sheet having a tensile strength exceeding a 1600 MPa-class or a thickness of more than 3.6 mm, which is likely to cause "galling" between the tool of press forming and the blank, is used as the blank, it is important to appropriately adjust the clearance.

Figure 11:
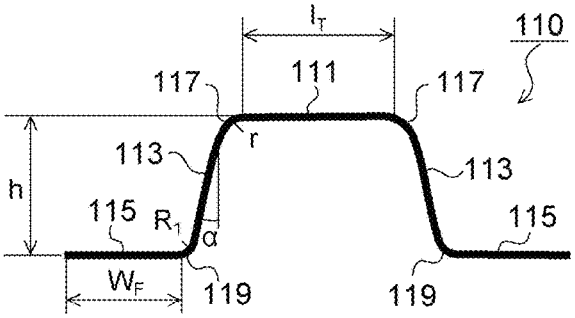
FIG. 11 is a diagram illustrating an example of a press formed part having the hat-shaped cross section in which flange portions of a pre-unbending press formed part having a hat-shaped cross section is unbent to form side wall portions by the press forming method according to the present embodiment ((a) Pre-unbending press formed part and (b) Press formed part having hat-shaped cross section).
Figure 11:
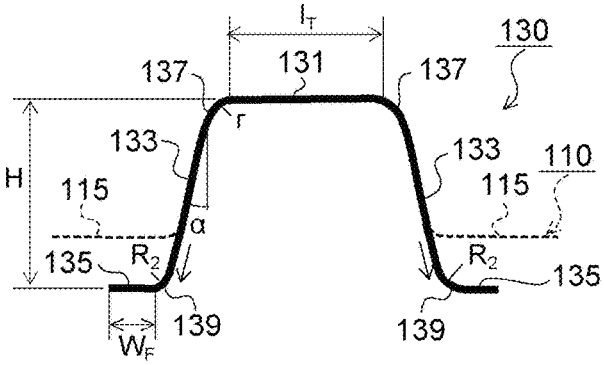
Figure 12:
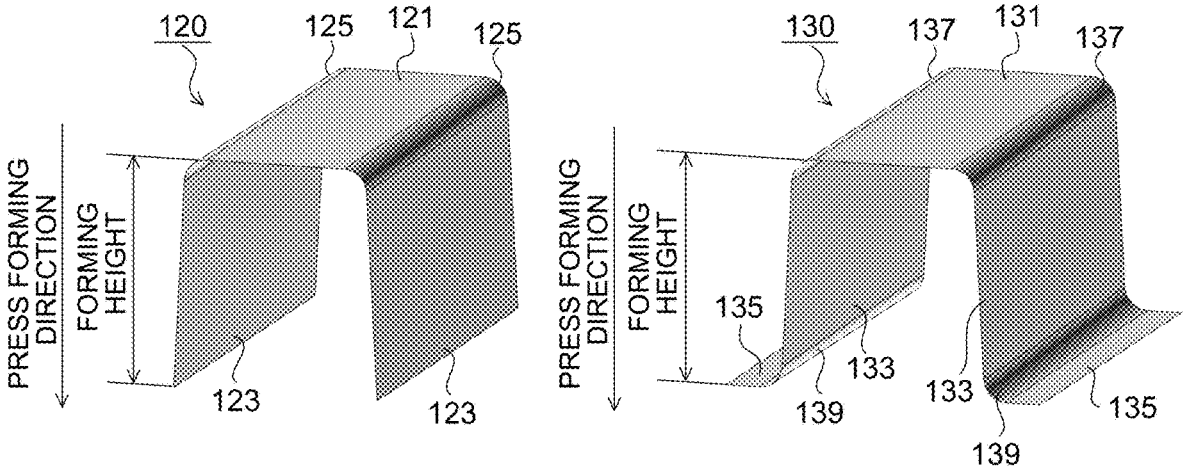
FIG. 12 is a diagram illustrating a press formed part having a U-shaped cross section or a hat-shaped cross section ((a) Press formed part having U-shaped cross section and (b) Press formed part having hat-shaped cross section).

Note that the description of the press forming method according to the present embodiment relates to the case of press-forming the press formed part 120 having the U-shaped cross section in which the entire flange portions 115 of the pre-unbending press formed part 110 having the hat-shaped cross section are unbent to form parts of the side wall portions 123. However, as illustrated in FIG. 11 as an example, the present invention may be configured to press-mold the press formed part 130 having the hat-shaped cross section in which parts of the flange portions 115 of the pre-unbending press formed part 110 are unbent to form parts of the side wall portions 133 and the remaining parts of the flange portions 115 are used as new flange portions 135. Also in this case, as in the case of press-forming the press formed part 120 having the U-shaped cross section illustrated in FIG. 4, by unbending the flange portions 115 while the punch side ridge line portions 11*d* of the punch 11 are brought into contact with the inner surface sides of the side wall portions 113 of the pre-unbending press formed part 110, the size (bending crease height) of the bending crease portions 141 remaining on the side wall portions 133 of the press formed part 130 having the hat-shaped cross section can be reduced.

Furthermore, in the invention, in a case where the press formed part curved along the longitudinal direction in a top view is the target shape, it is possible to suppress fractures due to stretch flange forming or wrinkles due to shrink flange forming in the curved press formed part in addition to reducing the size (bending crease height) of the bending crease portion remaining in the side wall portions of the press formed part.

In the present embodiment, the die 13 includes the die-side first sloped surface portion 13*b* and the die-side second sloped surface portion 13*c* parallel to the punch side first sloped surface portion 11*b* and the punch side second sloped surface portion 11*c*, respectively, and compresses the side wall portions 113 of the pre-unbending press formed part 110 in cooperation with the punch side first sloped surface portion 11*b* and the punch side second sloped surface portion 11*c*.

However, the present invention is not limited to one in which the die 13 includes the die-side first sloped surface portion 13*b* and the die-side second sloped surface portion 13*c* parallel to the punch side first sloped surface portion 11*b* and the punch side second sloped surface portion 11*c*, respectively. The side wall portions may be formed in such a manner as to extend along the punch side first sloped surface portion and the punch side second sloped surface portion by unbending the flange portion while bringing the punch side ridge line portion into contact with the inner surface sides of the side wall portions.

In addition, the present invention is not limited to one including only one step of unbending the flange portions of the pre-unbending press formed part having the hat-shaped cross section prepared in advance but also includes one in which a press formed part having the target shape is press-formed in two steps of a first forming step of press-forming the pre-unbending press formed part having the hat-shaped cross section and a second forming step of unbending the flange portions of the pre-unbending press formed part to form the side wall portions.

Note that, in a case where a press formed part to be formed by the invention is an automotive part, examples of the type of the automotive part include frame components such as an A pillar, a B pillar, a roof rail, a side rail, a front side member, a rear side member, and a cross member for which a high-strength metal sheet is used.

Example 1

In Example 1, press forming simulation was performed for each of a first forming step of press-forming the pre-unbending press formed part 110 having the hat-shaped cross section illustrated in FIG. 3(*a*) and a second forming step of press-forming the press formed part illustrated in FIG. 3(*b*) by unbending the flange portions 115 of the pre-unbending press formed part 110 to obtain the bending crease height of a bending crease portion generated in a side wall portion 123 of the press formed part 120.

In the first forming step, a metal sheet having a sheet thickness of 1.2 mm and a tensile strength of 1180 MPa-class was used as a blank 100, and the pre-unbending press formed part 110 having the top portion 111, the side wall portions 113, and the flange portions 115 illustrated in FIG. 3(*a*) was press-formed using a tool of press forming (not illustrated) including a punch, a die, and a blank holder.

The target shape of the pre-unbending press formed part 110 was a shape having a forming height h of 50 mm, a length $\mathbf{1}_T$ of the top portion 111 of 50 mm, an inclination angle α of the side wall portions 113 of 3°, a width $W_F$ of the flange portions 115 of 50 mm, and a bend radius of the punch shoulder part 117 and a bend radius of the die shoulder part 119 of 10 mm each. The dimensions of the punch and the die used in the first forming step were set so as to correspond to the target shape of the pre-unbending press formed part.

In the subsequent second forming step, as illustrated in FIG. 1, the entire flange portions 115 of the pre-unbending press formed part 110 were unbent using the tool of press forming 10 including the punch 11 and the die 13, and the press formed part 120 having the U-shaped cross section including the top portion 121 and the side wall portions 123 was press-formed.

The target shape of the press formed part 120 was set to be the same as that of the pre-unbending press formed part 110 in terms of the length of the top portion 121 and the bend radius of the punch shoulder parts 125.

Regarding the dimensions of the tool of press forming 10, the width of the top forming surface portion lie of the punch 11 was 50 mm, and the punch side first sloped surface portion lib and the die-side first sloped surface portion 13*b* were both inclined at an inclination angle of 3° which is equal to the inclination angle α of the side wall portions 113 of the pre-unbending press formed part 110.

In addition, the distance $h_2$ of the punch side ridge line portion 11*d* from the top forming surface portion lie was 50 mm, the inclination angle of the punch side first sloped surface portion 11*b* was α=3°, the inclination angle of the punch side second sloped surface portion 11*c* with respect to the punch side first sloped surface portion 11*b* was β=0 to 3°, the bend radius of the die shoulder part 119 was 10 mm, and the clearance between the punch side first sloped surface portion 11*b* and the die-side first sloped surface portion 13*b* and the clearance between the punch side second sloped surface portion 11*c* and the die-side second sloped surface portion 13*c* at the bottom dead center of forming were both set to 3% of the sheet thickness of the blank 100.

Then, the bending crease height of a bending crease portion 127 generated in a side wall portion 123 of the press formed part 120 formed in the second forming step was calculated. Incidentally, the bending crease height was set to the maximum value of the distance to the surface of the bending crease portion 127 in a direction perpendicular to the side wall portion 123.

In Example 1, as described below, the press forming simulation was performed by changing the inclination angle β of the punch side second sloped surface portion 11*c* and the position of the punch side ridge line portion 11*d* of the punch 11 used for press forming the press formed part 120, and the effect of reducing the bending crease height was examined.

Inclination Angle of Punch Side Second Sloped Surface Portion

In the present example, first, the inclination angle β of the punch side second sloped surface portion 11*c* of the punch 11 used in the second forming step was changed, and the bending crease height of the bending crease portion was examined.

Examples in which the inclination angle of the punch side second sloped surface portion 11*c* inward from the punch side first sloped surface portion 11*b* was set to β=1°, 2°, and 3° within a range of less than or equal to the inclination angle α (=3°) outward from the press forming direction of the punch side first sloped surface portion 11*b* were set as Example 1-1, Example 1-2, and Example 1-3, respectively, and the bending crease height of a bending crease portion 127 was obtained. In addition, for comparison, an example in which the press formed part 120 in which the flange portions 115 of the pre-unbending press formed part 110 were unbent to be formed into parts of the side wall portions 123 was press-formed using the conventional tool of press forming 40 illustrated in FIG. 4 was set as Comparative Example 1, and the bending crease height of a bending crease portion 127 was obtained similarly to Examples 1-1 to 1-3.

Table 1 shows results of the bending crease height of the press formed parts 120 in Example 1-1 to Example 1-3 and Comparative Example 1.

TABLE 1

| | Inclination Angle α of Punch-Side First Sloped Surface Portion (Outward from Press Forming Direction)/° | Inclination Angle β of Punch-Side Second Sloped Surface Portion (Inward from Punch-Side First Sloped Surface Portion)/° | Position $h_1$ of Ridge Line Portion/mm | Cross Sectional Shape of Press Formed Part | Bending Crease Height/mm |
|---|---|---|---|---|---|
| Example 1-1 | 3 | 3 | 50 | U-Shaped Cross Section | 1.24 |
| Example 1-2 | 3 | 2 | 50 | U-Shaped Cross Section | 1.35 |
| Example 1-3 | 3 | 1 | 50 | U-Shaped Cross Section | 1.52 |
| Comparative Example 1 | 3 | 0 | — | U-Shaped Cross Section | 1.72 |

The bending crease height in Comparative Example 1 was 1.72 mm. Meanwhile, the bending crease heights in Example 1-1, Example 1-2, and Example 1-3 were 1.24 mm, 1.35 mm, and 1.52 mm, respectively, which were all smaller than that of Comparative Example 1. This showed that the bending crease height of the bending crease portion 127 can be reduced by using the punch 11 including the punch side ridge line portion 11*d*.

Furthermore, from the results of Examples 1-1 to 1-3, it was shown that the effect of reducing the bending crease height is increased by increasing the inclination angle β of the punch side second sloped surface portion 11*c*. This is because the deformation of bending the die shoulder parts 119 in the reverse direction is promoted when the flange portions of the pre-unbending press formed part 110 is unbent.

Note that press forming simulation was also performed for a case where the inclination angle β of the punch side second sloped surface portion 11*c* was set to 4° which is larger than the inclination angle α of the punch side first sloped surface portion 11*b*.

In this case, even in a case where the inclination angle of the punch side second sloped surface portion 11*c* is larger than the inclination angle α of the punch side first sloped surface portion 11*b*, the flange portions of the pre-unbending press formed part 110 can be unbent to press-form the press formed part 120 by making the die 13 movable also in the horizontal direction to perform insert bending toward the punch 11.

Influence of Position of Punch Side Ridge Line Portion

Next, press forming simulation was performed for cases where the position of the punch side ridge line portion 11*d* of the punch 11 used in the second forming step was changed within the preferred range of the present invention, and the bending crease height of a bending crease portion was obtained.

Here, Examples in which the inclination angle of the punch side second sloped surface portion 11*c* inward from the punch side first sloped surface portion 11*b* direction was set to β=3° within a range of less than or equal to the inclination angle α outward from the press forming direction of the punch side first sloped surface portion 11*b* were set as Example 2-1 to 2-5.

Table 2 shows results of the bending crease height of the press formed parts 120 in Example 2-1 to Example 2-5 and Comparative Example 1 described above.

TABLE 2

| | Inclination Angle α of Punch-Side First Sloped Surface Portion (Outward from Press Forming Direction)/° | Inclination Angle β of Punch-Side Second Sloped Surface Portion (Inward from Punch-Side First Sloped Surface Portion)/° | Position $h_1$ of Ridge Line Portion/mm | Cross Sectional Shape of Press Formed Part | Bending Crease Height/mm |
|---|---|---|---|---|---|
| Example 2-1 | 3 | 3 | 38 | U-Shaped Cross Section | 1.24 |
| Example 2-2 | 3 | 3 | 48 | U-Shaped Cross Section | 1.23 |
| Example 2-3 | 3 | 3 | 57 | U-Shaped Cross Section | 1.24 |
| Example 2-4 | 3 | 3 | 30 | U-Shaped Cross Section | 1.45 |
| Example 2-5 | 3 | 3 | 70 | U-Shaped Cross Section | 1.45 |
| Comparative Example 1 | 3 | 0 | 70 | U-Shaped Cross Section | 1.7 |

In Example 2-1, the position of the punch side ridge line portion 11*d* is set within the preferred range of the present invention. The position of the punch side ridge line portion 11*d* is set to be within the range of the side wall-side plastic bending deformation region 113*a* in Example 2-1, within the range of the die shoulder part 119 in Example 2-2, and within the range of the flange-side plastic bending deformation region 115*a* in Example 2-3. The bending crease heights in Example 2-1, Example 2-2, and Example 2-3 were 1.24 mm, 1.23 mm, and 1.24 mm, respectively, and were greatly smaller as compared with the bending crease height in Comparative Example 1.

In Example 2-4 and Example 2-5, the position of the punch side ridge line portion 11*d* is set outside the preferred range of the present invention, and the punch side ridge line portion 11*d* is set on the side of the punch shoulder part 117 with respect to the side wall-side plastic bending deformation region 113*a* in Example 2-4 and on the distal end side of the flange portion 115 with respect to the flange-side plastic bending deformation region 115*a* in Example 2-5. The bending crease heights in Example 2-4 and Example 2-5 were each 1.45 mm, which was smaller than the bending crease height in Comparative Example 1 but larger than those in Example 2-1 to Example 2-3.

Example 2

In Example 2, press forming simulation was performed for each of the first forming step of press-forming the pre-unbending press formed part 110 having the hat-shaped cross section illustrated in FIG. 11(*a*) and the second forming step of press-forming the press formed part 130 having the hat-shaped cross section illustrated in FIG. 11(*b*) by unbending the flange portions 115 of the pre-unbending press formed part 110, and the size of a bending crease portion 141 generated in a side wall portion 133 of the press formed part 130 was examined.

In the press forming simulation, similarly to Example 1 described above, the press formed part 130 having the hat-shaped cross section obtained by press-forming was set as Example 3, in which a tool of press forming (not illustrated) including a punch having punch side first sloped surface portions, punch side second sloped surface portions, and punch side ridge line portions and a die having flange unbending portions is used to unbend parts of the flange portions 115 of the pre-unbending press formed part 110 on the side of the side wall portions 113 to be formed into the side wall portions 133, and portions of the flange portions 115 on a side opposite to the side wall portions 113 are obtained as the flange portions 135.

The target shape of the press formed part 130 was set to a shape having a forming height of H=80 mm and a width of the flange portion 135 of WF=20 mm. Incidentally, the punch used for the press forming of the press formed part 130 was set to have an inclination angle of the punch side first sloped surface portion of α=3° and an inclination angle of the punch side second sloped surface portion of β=3°. Other conditions regarding the target shape of the press formed part 130 and dimensions of the tool of press forming were similar to those of Example 1 described above.

Moreover, in Example 2, the press formed part 130 obtained by press-forming by unbending the flange portions 115 of the pre-unbending press formed part 110 using the conventional tool of press forming 40 was set as Comparative Example 2.

Then, for each of Example 3 and Comparative Example 2, the bending crease height of the bending crease portion 141 remaining in the side wall portion 133 of the press formed part 130 having the hat-shaped cross section was obtained. The bending crease height was obtained in a similar manner to that of the above-described embodiment (see FIG. 6). Table 3 shows results of the bending crease height in Example 3 and Comparative Example 2.

TABLE 3

| | Inclination Angle α of Punch-Side First Sloped Surface Portion (Outward from Press Forming Direction)/° | Inclination Angle β of Punch-Side Second Sloped Surface Portion (Inward from Punch-Side First Sloped Surface Portion)/° | Position $h_1$ of Ridge Line Portion/mm | Cross Sectional Shape of Press Formed Part | Bending Crease Height/mm |
|---|---|---|---|---|---|
| Example 3 | 3 | 3 | 50 | Hat-shaped Cross Section | 1.24 |
| Comparative Example 2 | 3 | 0 | — | Hat-shaped Cross Section | 1.71 |

The bending crease height in Comparative Example 2 was 1.71 mm. Meanwhile, the bending crease height in Example 3 was 1.24 mm, which was smaller than that in Comparative Example 2. As a result, it was shown that the bending crease height of the bending crease portion 141 can be reduced according to the press forming method of the present invention even in a case where the press formed part 130 having the hat-shaped cross section is set as the target shape.

INDUSTRIAL APPLICABILITY

According to the present invention, it is possible to provide a press forming method capable of reducing the size of a bending crease remaining in side wall portions of a press formed part obtained by unbending flange portions of the pre-unbending press formed part having a hat-shaped cross section to form the side wall portions without requiring a step of straightening the bending crease using a special device.

REFERENCE SIGNS LIST

10 TOOL OF PRESS FORMING
11 PUNCH
11*a* PUNCH SIDE SIDE-WALL FORMING SURFACE PORTION
11*b* PUNCH SIDE FIRST SLOPED SURFACE PORTION
11*c* PUNCH SIDE SECOND SLOPED SURFACE PORTION
11*d* PUNCH SIDE RIDGE LINE PORTION
11*e* TOP FORMING SURFACE PORTION
13 DIE
13*a* DIE-SIDE SIDE WALL FORMING SURFACE PORTION
13*b* DIE-SIDE FIRST SLOPED SURFACE PORTION
13*c* DIE-SIDE SECOND SLOPED SURFACE PORTION
13*d* FLANGE UNBENDING PORTION
13*e* FLANGE FORMING SURFACE PORTION
13*f* DIE SHOULDER PART
40 TOOL OF PRESS FORMING
41 PUNCH
41*a* PUNCH SIDE SIDE-WALL FORMING SURFACE PORTION
43 DIE
43*a* DIE-SIDE SIDE WALL FORMING SURFACE PORTION
43*b* FLANGE UNBENDING PORTION
110 PRE-UNBENDING PRESS FORMED PART
111 TOP PORTION
113 SIDE WALL PORTION
113*a* SIDE WALL-SIDE PLASTIC BENDING DEFORMATION REGION
115 FLANGE PORTION
115*a* FLANGE-SIDE PLASTIC BENDING DEFORMATION REGION
117 PUNCH SHOULDER PART
119 DIE SHOULDER PART
120 PRESS FORMED PART
121 TOP PORTION
123 SIDE WALL PORTION
125 PUNCH SHOULDER PART
127 BENDING CREASE PORTION
127*a* PORTION CORRESPONDING TO A SHOULDER PART OF A DIE
127*b* SIDE WALL-SIDE PORTION RECEIVING PLASTIC BENDING DEFORMATION
127*c* FLANGE-SIDE PORTION RECEIVING PLASTIC BENDING DEFORMATION
127*d* BOUNDARY
127*e* BOUNDARY
130 PRESS FORMED PART
131 TOP PORTION
133 SIDE WALL PORTION
135 FLANGE PORTION
137 PUNCH SHOULDER PART
139 DIE SHOULDER PART
141 BENDING CREASE PORTION
151 FLAT SURFACE PORTION
153 ELECTRODE
155 WELD PART

The invention claimed is:

1. A press forming method for a press formed part in which a pre-unbending press formed part having a hat-shaped cross section is unbent at flange portions using a punch and a die to form side wall portions, the pre-unbending press formed part including: a top portion; the side wall portions continuous from the top portion and inclined with respect to a press forming direction; and the flange portions continuous from the side wall portions via die shoulder parts, wherein the punch includes a top forming surface portion configured to form a top portion of the press formed part having a same shape as a shape of the top portion of the pre-unbending press formed part; and side-wall forming surface portions configured to form the side wall portions, each of the side-wall forming surface portions includes: a punch side first sloped surface portion that is continuous from and inclined outward from the top forming surface portion, the punch side first sloped surface portion having an inclination angle with respect to the press forming direction equal to an inclination angle of a side wall portion of the pre-unbending press formed part; and a punch side second sloped surface portion that is continuous from a lower end of the punch side first sloped surface portion and inclined inward from the punch side first sloped surface portion, the punch side first sloped surface portion and the punch side second sloped surface portion making a chevron shape convex outward, a punch side ridge line portion being formed at a connection portion of the punch side first sloped surface portion and the punch side second sloped surface portion, and the die includes flange unbending portions configured to unbend the flange portions of the pre-unbending press formed part placed on the punch, the press forming method comprising:

placing the pre-unbending press formed part on the punch;

relatively moving the die toward the punch; and unbending the flange portions by the flange unbending portions while the punch side ridge line portions are brought into contact with inner surface sides of the side wall portions to form the side wall portions of the press formed part.

2. The press forming method according to claim 1, wherein the die has an inner surface shape maintaining a clearance parallel to an outer surface of the punch.

3. The press forming method according to claim 1, wherein the punch side ridge line portion is formed at a position satisfying a following inequality:

$$h_1-R_1(1-\sin\alpha)-R_1/2\leq h_2\leq h_1-R_1(1-\sin\alpha)+2\pi R_1(90-\alpha)/360+R_1/2,$$

where $h_2$ denotes a distance (mm) in the press forming direction from the top forming surface portion of the punch to the punch side ridge line portion, $h_1$ denotes a forming height (mm) of the pre-unbending press formed part, $R_1$ denotes a bend radius (mm) of a die shoulder part of the pre-unbending press formed part, and a denotes an inclination angle (°) of the side wall portion of the pre-unbending press formed part with respect to the press forming direction.

4. The press forming method according to claim 2, wherein the punch side ridge line portion is formed at a position satisfying a following inequality:

$$h_1-R_1(1-\sin\alpha)-R_1/2\leq h_2\leq h_1-R_1(1-\sin\alpha)+2\pi R_1(90-\alpha)/360+R_1/2,$$

where $h_2$ denotes a distance (mm) in the press forming direction from the top forming surface portion of the punch to the punch side ridge line portion, $h_1$ denotes a forming height (mm) of the pre-unbending press formed part, $R_1$ denotes a bend radius (mm) of a die shoulder part of the pre-unbending press formed part, and a denotes an inclination angle (°) of the side wall portion of the pre-unbending press formed part with respect to the press forming direction.

* * * * *